US006249656B1

(12) United States Patent
Watanabe et al.

(10) Patent No.: US 6,249,656 B1
(45) **Date of Patent: *Jun. 19, 2001**

(54) IMAGE FORMING APPARATUS THAT REDUCES TEST TONER CLEANING

(75) Inventors: Toshifumi Watanabe, Toyohashi; Yasuyuki Inada, Toyokawa, both of (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/150,061

(22) Filed: Sep. 9, 1998

(30) Foreign Application Priority Data

Sep. 10, 1997 (JP) ..... 9-245842

(51) Int. Cl.[7] ..... G03G 15/16
(52) U.S. Cl. ..... 399/66; 399/49
(58) Field of Search ..... 399/46, 49, 66, 399/72, 99, 101, 299, 302, 303, 308, 310, 312, 314, 343, 313, 60

(56) References Cited

U.S. PATENT DOCUMENTS 5,287,163 * 2/1994 Miyashiro et al. ..... 399/66
5,541,708 * 7/1996 Tsuruoka ..... 399/60
5,559,590 * 9/1996 Arai et al. ..... 399/314
5,630,195 * 5/1997 Sawayama et al. ..... 399/49
5,732,312 * 3/1998 Takekoshi et al. ..... 399/299 X
5,754,919 * 5/1998 Sugimoto et al. ..... 399/49
5,761,572 * 6/1998 Watanabe et al. ..... 399/66
5,765,083 * 6/1998 Shinohara ..... 399/49 X
5,809,365 * 9/1998 Yoshizawa ..... 399/49 X
5,828,927 * 10/1998 Yoo et al. ..... 399/101
5,860,038 * 1/1999 Kato et al. ..... 399/49
5,873,011 * 2/1999 Takemoto et al. ..... 399/49

FOREIGN PATENT DOCUMENTS 59-198481 11/1984 (JP) .
61-140972 6/1986 (JP) .

* cited by examiner

*Primary Examiner*—Sandra Brase
(74) *Attorney, Agent, or Firm*—McDermott, Will & Emery

(57) ABSTRACT

The object of the present invention is to reduce the burden with regard to cleaning of the test toner pattern formed during AIDC in an electrophotographic image forming apparatus. In order to attain said object, the present invention is an electrophotographic copying machine that transfers a toner image formed on a photoreceptor drum onto a sheet of paper conveyed on a conveyor belt, wherein where the toner density of the test toner pattern formed on the photoreceptor drum under prescribed image formation parameters is optically detected by a sensor, the transfer charger output is set to be lower than it is in image formation mode, and a portion of the test toner pattern is transferred onto the conveyor belt and then wiped off by a cleaner.

16 Claims, 5 Drawing Sheets

IMAGE FORMING APPARATUS THAT REDUCES TEST TONER CLEANING

This application is based on application No. 9-245842 filed in Japan, the content of which is hereby incorporated by reference.

BACKGROUND OF THE INVENTION

1. Field of the Invention

The present invention pertains to an image forming apparatus, and more particularly, to an image forming apparatus that charges and exposes a photosensitive member rotated in one direction and develops the latent image on said image carrier into a toner image, and that transfers said toner image onto a belt or a sheet of paper conveyed on the belt.

2. Description of the Related Art

AIDC (auto-image density control) has conventionally been used in the areas of electrophotographic copying machines and laser printers, where, for the purpose of toner supply or image stabilization, a test pattern is formed on the photosensitive member using prescribed image forming parameters and the toner density of the test pattern is optically detected by a sensor to be fed back to either the supply of toner to the developer tank or to image forming parameters (such as photoreceptor charging voltage, exposure light amount and developing bias voltage).

On the other hand, in order to perform cleaning to remove the toner remaining on the photoreceptor, such means as application of an electric field prior to cleaning, erasure of the charge, or the use of a brush-type cleaner as a cleaner blade have been employed in order to stabilize and improve the cleaning performance.

These conventional cleaning improvement measures are intended for cleaning of the image forming unit. They assume that the transfer efficiency is approximately 90%, and therefore attempt to remove the remaining toner, which amounts to approximately 10%. However, in the test toner pattern formed using AIDC, 100% of the toner remains. This imposes an increased burden on cleaners, including those that incorporate said improvement measures, to clean said toner, and is one of the factors that accelerate the deterioration of the cleaner blade. It therefore leads to the problem that there still is toner remaining even after the cleaning.

In a color image forming apparatus in particular, due to the strong demand for high-quality images, the number of test patterns formed increases due to increased AIDC and the controlling of halftone density. This in turn increases the burden on the cleaner.

OBJECTS AND SUMMARY

The object of the present invention is to provide an image forming apparatus that performs the cleaning of the test toner patterns formed during AIDC using not just one cleaner but other cleaners as well, so that the burden on the cleaners may be reduced.

In order to achieve said object, the present invention provides an image forming apparatus that includes the following components:

an image carrier that is rotated;

a developing device that forms a toner image on said image carrier, said developing device forming a test toner pattern on said image carrier at a prescribed time;

a transfer device that transfers said toner image or test toner pattern onto a recording medium located on a recording medium carrier at a transfer area;

a first cleaning device that removes the remaining toner on said image carrier;

a second cleaning device that removes the remaining toner on said recording medium carrier;

a detecting device that detects the toner density of the test toner pattern; and a control device that, when the test toner pattern whose toner density is detected by said detecting device passes through the transfer area, reduces the output of said transfer device to be smaller than the output used when a toner image is transferred.

BRIEF DESCRIPTION OF THE DRAWINGS

These and other objects and features of the present invention will become apparent from the following description of preferred embodiments thereof taken in conjunction with the accompanying drawings, in which.

In the following description, like parts are designated by like reference numbers throughout the several drawings.

DETAILED DESCRIPTION OF THE PREFERRED EMBODIMENTS

In order to attain said object, the image forming apparatus pertaining to one embodiment of the present invention is equipped with a first cleaning means that removes the remaining toner of the image carrier, a second cleaning means that removes the remaining toner on the belt used to transfer the toner image from the image carrier onto the sheet of paper, a detecting means that detects the toner density of the test toner pattern formed on the image carrier using prescribed image formation parameters, and a control means that, when the test toner pattern whose toner density is detected by said detecting means passes through the transfer area, reduces the intensity of the electric field output from the transfer means to be smaller than the electric field intensity output used when a toner image is transferred.

In the present invention, a portion of the test toner pattern is transferred to the belt and the transferred toner is removed from the belt by means of the second cleaning means, by virtue of operating the transfer means at a lower output when AIDC is executed. On the other hand, toner that was not transferred to the belt remains on the image carrier. This remaining toner is removed by means of the first cleaning means.

Normally a test toner pattern formed on the image carrier is not transferred and is removed by the first cleaning means after density detection. In the present invention, a portion of the test pattern is transferred onto the belt and cleaned. As a result, the burden on the first cleaning means is reduced and such problems as the deterioration of the cleaner blade and toner remaining after cleaning are avoided.

Further, if the image forming apparatus of the present invention is a tandem-style full-color image forming apparatus comprising multiple image carriers aligned along the direction of movement of the belt, for example, it is preferred that the locations of the test toner patterns formed on each image carrier differ from each other across the width of the belt perpendicular to the direction of movement of the belt. By scattering the locations at which a test toner pattern is formed, the burden on the second cleaning means may be dispersed and localized early deterioration of the cleaner blade may be prevented.

The embodiments of the image forming apparatus pertaining to the present invention are explained below with reference to the accompanying drawings.

(First Embodiment)

Figure 1:
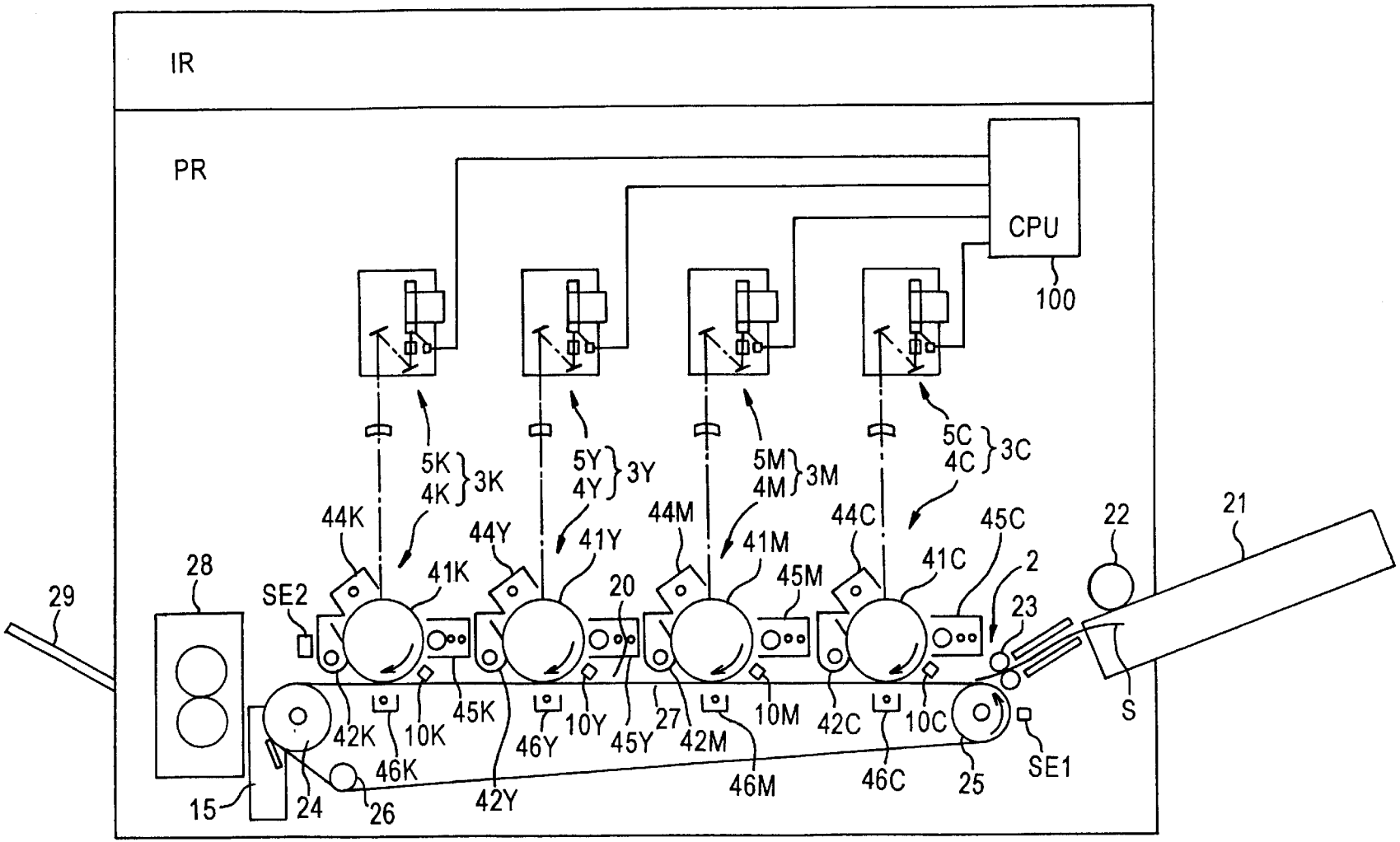
FIG. 1 shows an outline of the construction of a full-color copying machine, a first embodiment of the present invention.

FIG. 1 shows a tandem-style full-color copying machine, which is a first embodiment of the present invention. This copying machine essentially comprises an image reader IR that reads the original document image and a printer PR that reproduces the read image onto a sheet of recording paper S.

The image reader IR reads the original document image by breaking it down into the three primary colors of red, green and blue by means of an image sensor such as a CCD. The construction and operation of the image reader IR are in the public domain and therefore their explanation is omitted.

The printer PR is equipped with a conveyance area 2 that includes a recording paper conveyance path 20 that runs along the surface of a conveyor belt 27, and image forming units 3C (cyan), 3M (magenta), 3Y (yellow) and 3K (black) to form four overlapping color images on a sheet of recording paper S. Image forming units 3C, 3M, 3Y and 3K comprise processing units 4C, 4M, 4Y and 4K located along conveyance path 20 and laser scanning optical systems 5C, 5M, 5Y and 5K.

Conveyance area 2 is constructed around circular conveyor belt 27 that is suspended over a drive roller 24, a driven roller 25 and a tension roller 26. A sheet of recording paper S is conveyed on conveyor belt 27 at a constant speed. On the upstream side of conveyor belt 27 (the right-hand side in FIG. 1) are located a paper supply cassette 21 that houses recording paper S of a prescribed size in a stack, a paper supply roller 22 that supplies recording paper S sheet by sheet from the paper supply cassette 21, and a timing roller 23 that feeds the supplied sheets of recording paper S onto the conveyor belt 27 in accordance with a prescribed timing sequence.

On the other hand, on the downstream side of conveyor belt 27 are located a fusing unit 28 to fuse the toner transferred onto the sheet of recording paper S and a paper eject tray 29 that houses in a stack sheets of recording paper S onto which toner fusion has been completed. In addition, sensors SE1 and SE2 are located on the upstream side and downstream side of conveyor belt 27, respectively, to detect timing and paper jam problems in the paper feed operation. A remaining toner cleaner 15 is located in the area of conveyor belt 27 that is supported by roller 24.

The processing units 4C, 4M, 4Y and 4K form an image using the electrostatic copying method, and are constructed around photoreceptor drums 41C, 41M, 41Y and 41K aligned above conveyor belt 27. Around photoreceptor drums 41C, 41M, 41Y and 41K are located cleaners 42C, 42M, 42Y and 42K, chargers 44C, 44M, 44Y and 44K, and developing units 45C, 45M, 45Y and 45K. Immediately below photoreceptor drums 41C, 41M, 41Y and 41K and conveyor belt 27 are located transfer chargers 46C, 46M, 4(5Y and 46K.

Further, the sensors 10C, 10M, 10Y and 10K to perform AIDC are located immediately below the developing units 45C, 45M, 45Y and 45K The AIDC sensors 10C, 10M, 10Y and 10K are in the public domain, and each comprises one light emitting element and one light receiving element. They output as a voltage signal the increase or decrease in reflected light that corresponds to the adhering toner amount. AIDC is explained below.

The operation of the copying machine will now be explained. First, the control unit 100 performs necessary data processing including shading correction, density conversion and edge enhancement with regard to the image data for each color component, i.e., red, green and blue, obtained from the image reader IR. It then converts the image data into image data for each reproduction color, i.e., cyan, magenta, yellow and black, and temporarily saves the image data in its image memory.

The laser scanning optical systems 5C, 5M, 5Y and 5K then modulate and emit laser light for each reproduction color based on the image data stored in the image memory. The photoreceptor drums 41C, 41M, 41Y and 41K rotate in a clockwise direction in FIG. 1. Their surfaces are uniformly charged by chargers 44C, 44M, 44Y and 44K, and are then exposed and scanned by the laser light.

Through this exposure, the electrostatic latent images formed on the photoreceptor drums 41C, 41M, 41Y and 41K that correspond to each of the reproduction colors are developed by means of the developing units 45C, 45M, 45Y and 45K into toner images of their respective colors. These toner images are sequentially transferred onto the sheet of recording paper S supplied from the paper supply cassette 21 one on top of another by means of the transfer chargers 46C, 46M, 46Y and 46K in the areas where the photoreceptor drums 41C, 41M, 41Y and 41K face the conveyor belt 27. Subsequently, the sheet of recording paper S onto which the toner images of the four colors are placed in an overlapping fashion are heated in fusing device 28. This fuses each toner image, thereby bonding each of them onto the sheet of recording paper S. After fusing of the toner images is completed, the sheet of recording paper S is ejected onto the paper eject tray 29.

Figure 3:
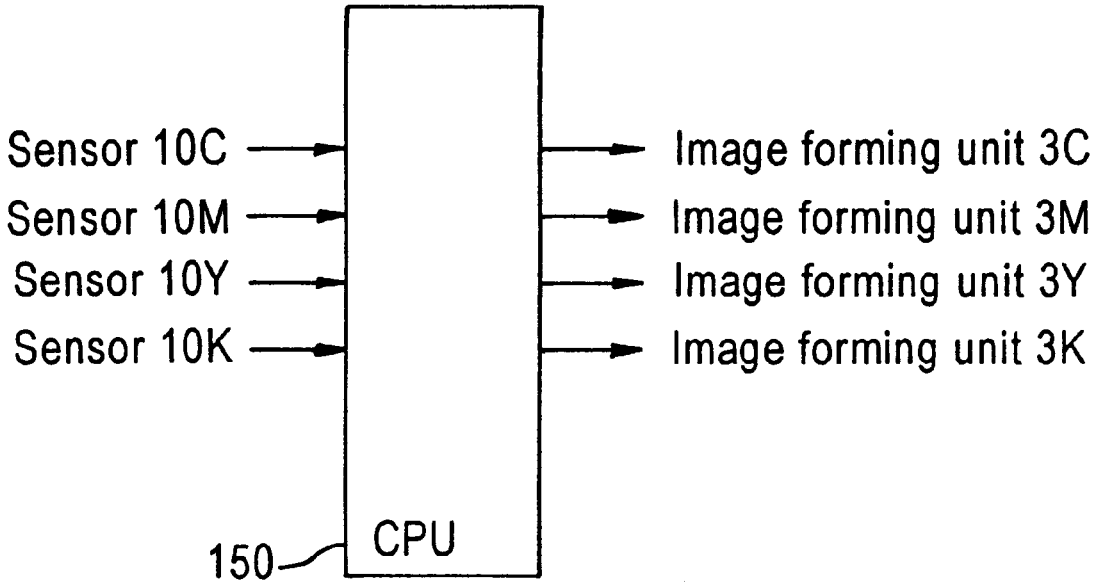
FIG. 3 is a block diagram showing important components of a control circuit of the copying machine.

Next, AIDC will be explained. Test toner patterns are formed on the photoreceptor drums 41C, 41M, 41Y and 41K using prescribed image formation parameters (charging voltage, exposure light amount and developing bias voltage), and the toner densities of these patterns are detected by the sensors 10C, 10M, 10Y and 10K, respectively, immediately before they reach the transfer areas. The toner density detection signals from the sensors 10C, 10M, 10Y and 10K are input to the CPU 150 shown in FIG. 3, and are then fed back to image density control signals and output to the image forming units 3C, 3M, 3Y and 3K. There are various methods for controlling image density, such as controlling the toner supply to the developing units 45C, 45M, 45Y and 45K, controlling the developing bias voltage, controlling the output from the chargers 44C, 44M, 44Y and 44K (in other words, the photoreceptor charging voltage), or controlling the exposure light amount, and these methods may be used individually or in combination.

Incidentally, in this AIDC, when the test toner patterns respectively formed on the photoreceptor drums 41C, 41M, 41Y and 41K pass through the transfer areas, the intensities of the electric fields output from the transfer chargers 46C, 46M, 46Y and 46K are made weaker than those of the electric fields output when toner images are transferred in image formation mode. For example, in order to achieve a transfer efficiency of 50%, the output voltages of the power transformers of transfer chargers 46C, 46M, 46Y and 46K are changed by means of the CPU 150. When this occurs, 50% of the toner from the test toner patterns is transferred onto conveyor belt 27 and eliminated by the cleaner 15. On the other hand, the 50% of toner remaining on the photoreceptor drums 41C, 41M, 41Y and 41K is eliminated by the cleaners 42C, 42M, 42Y and 42K, respectively.

As described above, by distributing the cleaning of the toner of the test toner patterns to not only the cleaners 42C, 42M, 42Y and 42K, but also to the cleaner 15, the burden on the cleaners 42C, 42M, 42Y and 42K is reduced, and the problems of deterioration in the cleaner blades and the leaving of remaining toner on the photoreceptor drums 41C, 41M, 41Y and 41K can be avoided. The level of test toner pattern transfer efficiency set during AIDC is appropriately determined in accordance with the capabilities of the cleaners 42C, 42M, 42Y, 42K and 15.

Figure 2:
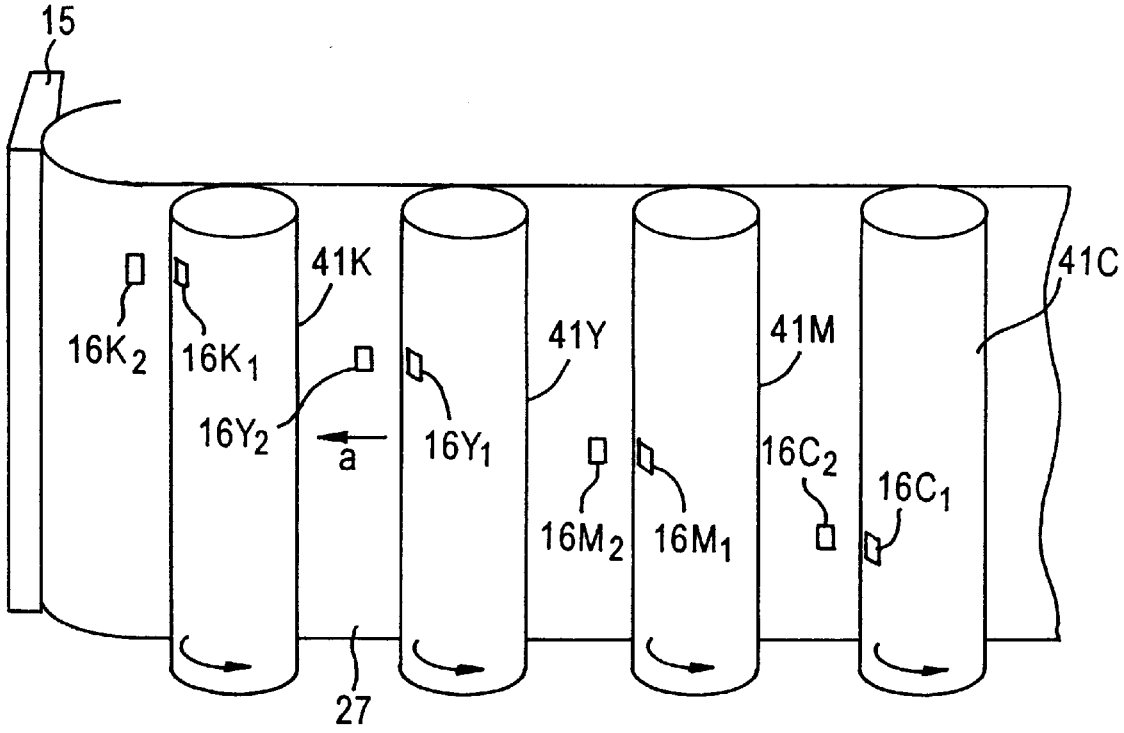
FIG. 2 is a perspective view showing a test toner pattern formation position.

Furthermore, in the first embodiment, the positions of test toner patters 16C1, 16M1, 16Y1 and 16K1 formed on the photoreceptor drums 41C, 41Y, 41M and 41K differ from each other across the width of the conveyor belt 27 perpendicular to the direction of movement of said belt (the direction indicated by arrow a), as shown in FIG. 2. 16C2, 16M2, 16Y2 and 16K2 in FIG. 2 indicate some of the test toner patterns transferred onto the conveyor belt 27. By dispersing the test toner pattern formation positions in this way, the burden on the cleaner 15 is distributed more evenly and localized deterioration in the cleaner blades can be reduced.

(Second embodiment)

Figure 4:
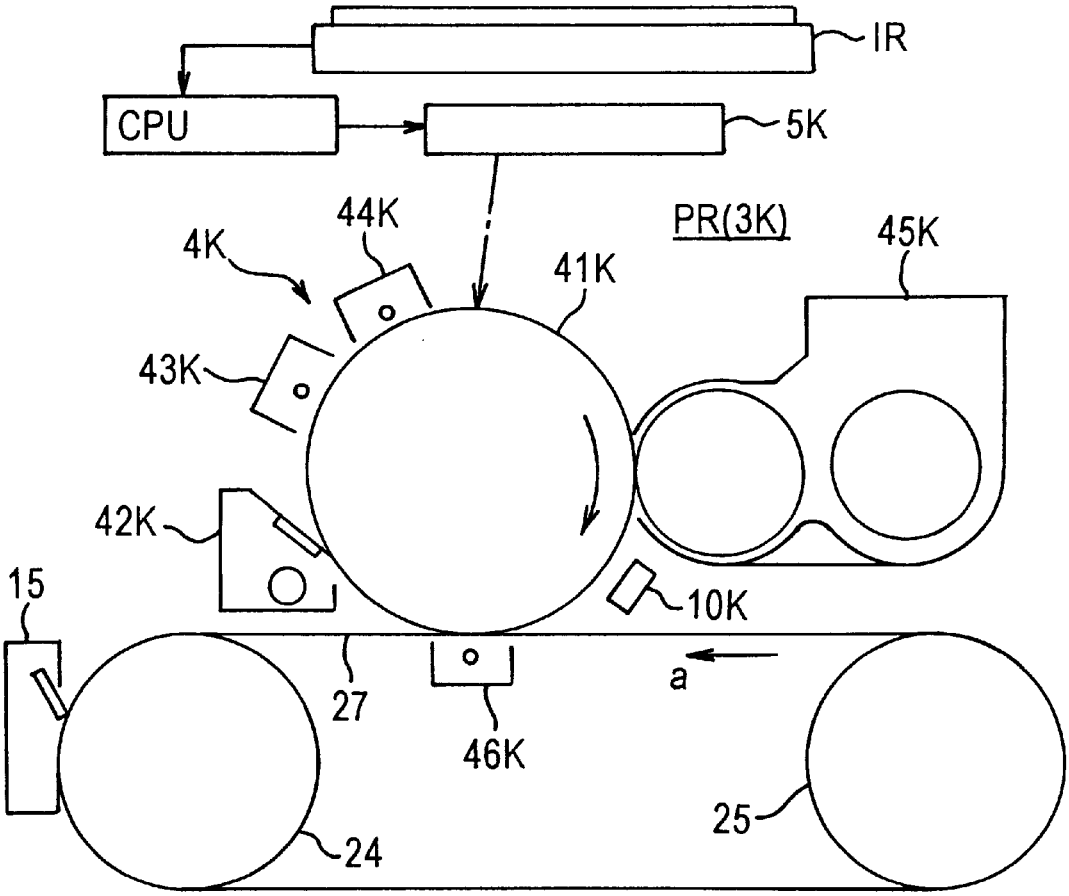
FIG. 4 shows an outline of the construction of a digital copying machine, a second embodiment of the present invention.

The second embodiment shown in FIG. 4 is a digital copying machine that forms black and white images, and essentially comprises the single black image forming unit 3K shown in FIG. 1. Therefore, in FIG. 4 the same numbers are used to indicate the same parts of said black image forming unit 3K, and their explanation will be omitted here. In addition, the discharge charger 43K to eliminate remaining charge is shown in FIG. 4.

In the second embodiment as well, when AIDC is executed, a portion of the test toner pattern is transferred to the conveyor belt 27 and eliminated by the cleaner 15 by operating the transfer charger 46K at low output.

The image forming apparatus pertaining to the present invention is not limited to the embodiments described above, and may be changed in various ways within its essential scope.

Figure 5:
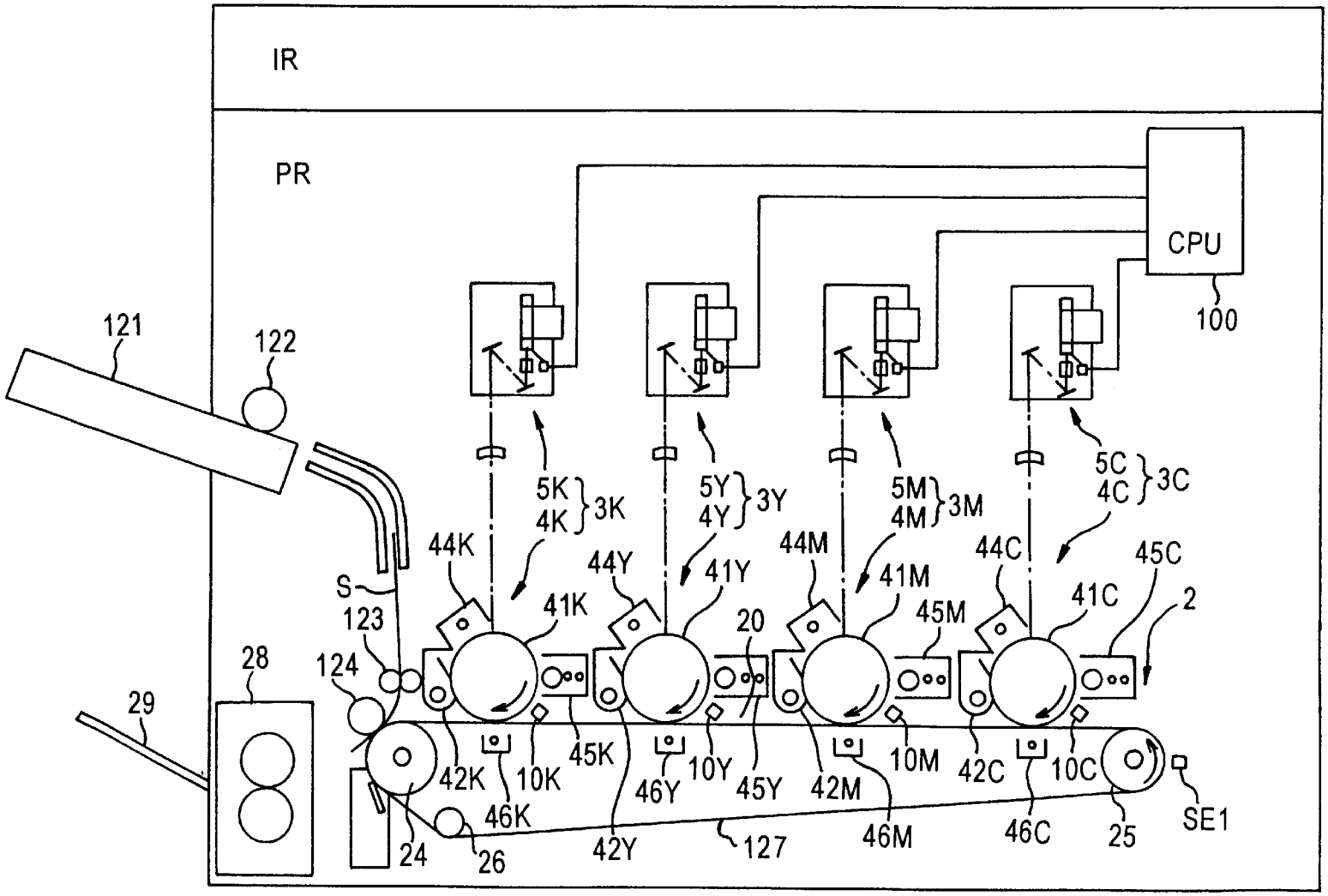
FIG. 5 shows a digital copying machine with an intermediate transfer belt.

In particular, for the full-color transfer-type image forming apparatus, it is acceptable if a dielectric intermediate transfer belt is used instead of said conveyor belt 27, so that the four-color toner images are first transferred and synthesized on this belt and then transferred again onto a sheet of paper. FIG. 5 shows a tandem-style full-color copying machine similar to that shown in FIG. 1, but with intermediate transfer belt 127 instead of the conveyor belt 27. In addition paper supply cassette 121 and paper supply roller 122 are used instead of paper supply cassette 21 and paper supply roller 22. In this case, the output of the first transfer charger will be reduced such that the toner of the test toner patterns may be distributed between the photoreceptor drum and the intermediate transfer belt.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

a conveyer member for carrying a transfer sheet:

an image forming device that comprises an image carrier, a toner image forming device for forming a toner image on said image carrier, a transfer device for transferring said toner image from the image carrier to the transfer sheet on the conveyer member as a toner image transfer operation and a cleaner for removing a remaining toner on said image carrier;

a control device for controlling the toner image forming device to form a test toner pattern on the image carrier and controlling the transfer device to transfer the test toner pattern from the image carrier to the conveyer member as a test toner pattern transfer operation, wherein an output of said transfer device while performing the test toner pattern transfer operation is smaller than that of said transfer device while performing the toner image transfer operation; and a cleaning device for removing the transferred test toner pattern on the conveyer member.

2. The image forming apparatus claimed in claim 1, wherein the image forming device further comprises a detecting device for detecting a toner density of the test toner pattern.

3. The image forming apparatus claimed in claim 1, wherein the toner image forming device comprises a charger for charging the image carrier, an exposing device for exposing the charged image carrier to form an electrostatic latent image and a developing device for developing the latent image to form the toner image on the image carrier.

4. The image forming apparatus claimed in claim 1, wherein the conveyer member is a conveyer belt.

5. The image forming apparatus claimed in claim 1, wherein the image forming device comprises a first image forming device and a second image forming device, the first image forming device comprising a first image carrier, a first toner image forming device for forming a first toner image on the first image carrier, a first transfer device for transferring the first toner image from the first image carrier to the transfer sheet on the conveyer member as a first toner image transfer operation and a first cleaner for removing a remaining toner on the first image carrier, the second image forming device comprising a second image carrier, a second toner image forming device for forming a second toner image on the second image carrier, a second transfer device for transferring the second toner image from the second image carrier to the transfer sheet on the conveyer member as a second toner image transfer operation and a second cleaner for removing a remaining toner on the second image carrier, the control device for controlling the first toner image forming device to form a first test toner pattern on the first image carrier, controlling the second toner image forming device to form a second test toner pattern on the second image carrier, controlling the first transfer device to transfer the first test toner pattern from the first image carrier to the conveyer member as a first test toner pattern transfer operation and controlling the second transfer device to transfer the second test toner pattern from the second image carrier to the conveyer member as a second test toner pattern transfer operation, wherein the output of the first transfer device while performing the first test toner pattern transfer operation is smaller than that of the first transfer device while performing the first toner image transfer operation, and the output of the second transfer device while performing the second test toner pattern transfer operation is smaller than that of the second transfer device while performing the second toner image transfer operation.

6. The image forming apparatus claimed in claim 5, wherein a position of the first test toner pattern formed on the first image carrier is different from a position of the second test toner pattern formed on the second image carrier with respect to a perpendicular direction to a direction of movement of the conveyer member.

7. An image forming apparatus comprising:

an intermediate transfer member;

an image forming device that comprises an image carrier, a toner image forming device for forming a toner image on said image carrier, a transfer device for transferring said toner image from the image carrier to the intermediate transfer member as a toner image transfer operation and a cleaner for removing a remaining toner on said image carrier;

a control device for controlling the toner image forming device to form a test toner pattern on the image carrier and controlling the transfer device to transfer the test toner pattern from the image carrier to the intermediate transfer member as a test toner pattern transfer operation, wherein an output of said transfer device while performing the test toner pattern transfer operation is smaller than that of said transfer device while performing the toner imager transfer operation; and a cleaning device for removing the transferred test toner pattern on the intermediate transfer member.

8. The image forming apparatus claimed in claim 7, wherein the image forming device further comprises a detecting device for detecting a toner density of the test toner pattern.

9. The image forming apparatus claimed in claim 7, wherein the toner image forming device comprises a charger for charging the image carrier, an exposing device for exposing the charged image carrier to form an electrostatic latent image and a developing device for developing the latent image to form the toner image on the image carrier.

10. The image forming apparatus claimed in claim 7, wherein the intermediate transfer member is an intermediate transfer belt.

11. The image forming apparatus claimed in claim 7, wherein the image forming device comprises a first image forming device and a second image forming device, the first image forming device comprising a first image carrier, a first toner image forming device for forming a first toner image on the first imager carrier, a first transfer device for transferring the first toner image from the first image carrier to the intermediate transfer member as a first toner image transfer operation and a first cleaner for removing a remaining toner on the first image carrier, the second image forming device comprising a second image carrier, a second toner image forming device for forming a second toner image on the second image carrier, a second transfer device for transferring the second toner image from the second image carrier to the intermediate transfer member as a second toner image transfer operation and a second cleaner for removing a remaining toner on the second image carrier, the control device for controlling the first toner image forming device to form a first test toner pattern on the first image carrier, controlling the second toner image forming device to form a second test toner pattern on the second image carrier, controlling the first transfer device to transfer the first test toner pattern from the first image carrier to the intermediate transfer member as a first test toner pattern transfer operation and controlling the second transfer device to transfer the second test toner pattern from the second image carrier to the intermediate transfer member as a second test toner pattern transfer operation, wherein the output of the first transfer device while performing the first test toner pattern transfer operation is smaller than that of the first transfer device while performing the first toner image transfer operation, and the output of the second transfer device while performing the second test toner pattern transfer operation is smaller than that of the second transfer device while performing the second toner image transfer operation.

12. The image forming apparatus claimed in claim 11, wherein a position of the first test toner pattern formed on the first image carrier is different from a position of the second test toner pattern formed on the second image carrier with respect to a perpendicular direction to a direction of movement of the intermediate transfer member.

13. An image forming method comprising:

in a toner image forming mode, forming a toner image on an image carrier;

transferring the toner image from the image carrier to a transfer sheet supported on a conveyer member by a transfer device; and removing a remaining toner from the image carrier;

in a test toner pattern forming mode, forming a test toner pattern on the image carrier;

detecting a toner density of the test toner pattern;

transferring the test toner pattern from the image carrier to the conveyer member by the transfer device; and removing the transferred test toner pattern from the conveyer member, wherein an output of the transfer device in the test toner pattern forming mode is smaller than that of the transfer device in the toner image forming mode.

14. The image forming method claimed in claim 13, which comprises:

in the toner image forming mode, forming a first toner image on a first image carrier;

transferring the first toner image from the first image carrier to the transfer sheet supported on the conveyer member by a first transfer device;

removing a remaining toner from the first image carrier;

forming a second toner image on a second image carrier;

transferring the second toner image from the second image carrier to the transfer sheet by a second transfer device; and removing a remaining toner from the second image carrier;

in the test toner pattern forming mode, forming a first test toner pattern on the first image carrier;

detecting a toner density of the first test toner pattern;

transferring the first test toner pattern from the first image carrier to the conveyer member by the first transfer device;

forming a second test toner pattern on the second image carrier;

detecting a toner density of the second test toner pattern;

transferring the second test toner pattern from the second image carrier to the conveyer member by the second transfer device; and removing the transferred first and second test toner patterns from the conveyer member, wherein an output of the first transfer device in the test toner pattern forming mode is smaller than that of the first transfer device in the toner image forming mode and an output of the second transfer device in the test toner pattern forming mode is smaller than that of the second transfer device in the toner image forming mode.

15. An image forming method comprising:

in a toner image forming mode, forming a toner image on an image carrier;

transferring the toner image from the image carrier to an intermediate transfer member by a transfer device; and removing a remaining toner from the image carrier;

in a test toner pattern forming mode, forming a test toner pattern on the image carrier;

detecting a toner density of the test toner pattern;

transferring the test toner pattern from the image carrier to the intermediate transfer member by the transfer device; and removing the transferred test toner pattern from the intermediate transfer member, wherein an output of the transfer device in the test toner pattern forming mode is smaller than that of the transfer device in the toner image forming mode.

16. The image forming method claimed in claim 15, which comprises:

in the toner image forming mode, forming a first toner image on a first image carrier;

transferring the first toner image from the first image carrier to the intermediate transfer member by a first transfer device;

removing a remaining toner from the first image carrier;

forming a second toner image on a second image carrier;

transferring the second toner image from the second image carrier to the intermediate transfer member by a second transfer device; and removing a remaining toner from the second image carrier;

in the test toner pattern forming mode, forming a first test toner pattern on the first image carrier;

detecting a toner density of the first test toner pattern;

transferring the first test toner pattern from the first image carrier to the intermediate transfer member by the first transfer device;

forming a second test toner pattern on the second image carrier;

detecting a toner density of the second test toner pattern;

transferring the second test toner pattern from the second image carrier to the intermediate transfer member by the second transfer device; and removing the transferred first and second test toner patterns from the intermediate transfer member, wherein an output of the first transfer device in the test toner pattern forming mode is smaller than that of the first transfer device in the toner image forming mode and an output of the second transfer device in the test toner pattern forming mode is smaller than that of the second transfer device in the toner image forming mode.

* * * * *